US009308425B2

(12) United States Patent
Choi et al.

(10) Patent No.: US 9,308,425 B2
(45) Date of Patent: Apr. 12, 2016

(54) APPARATUS, METHOD, AND SYSTEM FOR CONTROLLING BOOMERANG

(71) Applicant: Daegu Gyeongbuk Institute of Science and Technology, Daegu (KR)

(72) Inventors: Youn Ho Choi, Daegu (KR); Dong Ha Lee, Daegu (KR); Su Jin Lee, Daegu (KR)

(73) Assignee: DAEGU GYEONGBUK INSTITUTE OF SCIENCE AND TECHNOLOGY, Daegu (KR)

( * ) Notice: Subject to any disclaimer, the term of this patent is extended or adjusted under 35 U.S.C. 154(b) by 302 days.

(21) Appl. No.: 14/050,380

(22) Filed: Oct. 10, 2013

(65) Prior Publication Data

US 2014/0135155 A1 May 15, 2014

(30) Foreign Application Priority Data

Nov. 13, 2012 (KR) ..... 10-2012-0128441

(51) Int. Cl.

| | |
|---|---|
| ***A63B 65/08*** | (2006.01) |
| ***A63B 24/00*** | (2006.01) |
| ***F42B 6/00*** | (2006.01) |
| ***F42B 10/62*** | (2006.01) |
| ***F42B 15/01*** | (2006.01) |
| ***F41B 15/00*** | (2006.01) |

(52) U.S. Cl.

CPC ..... *A63B 65/08* (2013.01); *A63B 24/0006* (2013.01); *A63B 24/0021* (2013.01); *F41B 15/00* (2013.01); *F42B 6/00* (2013.01); *F42B 10/62* (2013.01); *F42B 15/01* (2013.01); *A63B 2024/0015* (2013.01); *A63B 2024/0034* (2013.01); *A63B 2220/12* (2013.01); *A63B 2220/16* (2013.01); *A63B 2220/30* (2013.01); *A63B 2220/35* (2013.01); *A63B 2220/807* (2013.01); *A63B 2220/833* (2013.01); *A63B 2225/50* (2013.01)

(58) Field of Classification Search

CPC ..... A63B 65/08

See application file for complete search history.

(56) References Cited

U.S. PATENT DOCUMENTS 5,634,839 A * 6/1997 Dixon ..... A63H 27/00 446/37
5,672,086 A * 9/1997 Dixon ..... A63H 27/00 446/37
5,868,596 A * 2/1999 Perthou ..... A63H 33/185 446/36

(Continued)

FOREIGN PATENT DOCUMENTS

KR 10-1054275 B1 8/2011

*Primary Examiner* — David L Lewis
*Assistant Examiner* — Shauna-Kay Hall
(74) *Attorney, Agent, or Firm* — Revolution IP, PLLC

(57) ABSTRACT

Provided are an apparatus and method of controlling a boomerang. The apparatus includes: a detection unit for detecting moving information of a boomerang including a plurality of wings; a movement prediction unit for generating movement prediction information of the boomerang by using the detected moving information; and a control unit for controlling an angular velocity of a rotation shaft connected to the plurality of wings or a flap angle of the plurality of wings of the boomerang according to the generated movement prediction information. Accordingly, the boomerang may accurately move to a target place by controlling flight of the boomerang by using moving information of the boomerang. Also, a flight distance of the boomerang may be increased by switching a flight state from non-power flight to powered flight.

9 Claims, 4 Drawing Sheets

(56) References Cited

U.S. PATENT DOCUMENTS

| | | | | |
|---|---|---|---|---|
| 8,382,546 | B2 * | 2/2013 | Van Ruymbeke ... | A63H 27/008 244/11 |
| 8,493,324 | B2 * | 7/2013 | Kuo ..... | G06F 3/0346 340/669 |
| 2004/0041059 | A1 * | 3/2004 | Kennedy ..... | F42B 10/14 244/3.29 |
| 2006/0155508 | A1 * | 7/2006 | Choi ..... | G01S 5/186 702/150 |
| 2010/0240478 | A1 | 9/2010 | Ho | |
| 2011/0003526 | A1 * | 1/2011 | Mathieu ..... | A63H 27/008 446/34 |
| 2011/0250819 | A1 * | 10/2011 | Tashman ..... | A63H 33/18 446/46 |
| 2012/0003896 | A1 * | 1/2012 | Van Ruymbeke ... | A63H 27/008 446/35 |

* cited by examiner

APPARATUS, METHOD, AND SYSTEM FOR CONTROLLING BOOMERANG

CROSS-REFERENCE TO RELATED PATENT APPLICATION

This application claims the benefit of Korean Patent Application No. 10-2012-0128441, filed on Nov. 13, 2012, in the Korean Intellectual Property Office, the disclosure of which is incorporated herein in its entirety by reference.

BACKGROUND OF THE INVENTION

1. Field of the Invention

The present invention relates to an apparatus, method, and system for controlling a boomerang, and more particularly, to a technology of controlling a boomerang capable of self-flight.

2. Description of the Related Art

Generally, a boomerang includes a plurality of wings in different directions, and flies towards a target and then returns to an original place when thrown forward. Thus, the boomerang was used for hunting, but nowadays used for sports. Since the boomerang flies according to a physical force of a user applied when the user throws the boomerang, a flight distance of the boomerang is limited, and a direction of the boomerang may be changed by wind. Thus, a flight path of the boomerang may be changed according to different forces and techniques of throwing the boomerang of users.

Conventionally, in order to extend a flight distance of a boomerang, a structure of the boomerang was changed or a technology of applying a uniform physical force to the boomerang by using an external device was developed. However, in this case, the flight distance is increased compared to when the flight distance is dependent upon a force and technique of a user, but when a destination of the boomerang changes, the flight distance cannot be actively increased.

A background technology of the present invention is disclosed in KR 10-1054275 (registered on 29 July).

SUMMARY OF THE INVENTION

The present invention provides an apparatus, method, and system for controlling a boomerang, wherein flight of the boomerang is controlled by using moving information of the boomerang.

According to an aspect of the present invention, there is provided an apparatus for controlling a boomerang, the apparatus including: a detection unit for detecting moving information of a boomerang including a plurality of wings; a movement prediction unit for generating movement prediction information of the boomerang by using the detected moving information; and a control unit for controlling an angular velocity of a rotation shaft connected to the plurality of wings or a flap angle of the plurality of wings of the boomerang according to the generated movement prediction information.

The detection unit may detect at least one of a tilt, a location, a flight speed, and an angular velocity of the boomerang.

The control unit may control the angular velocity of the rotation shaft when the movement prediction information is different from a predetermined flight speed, control the flap angle of the plurality of wings when the movement prediction information is different from a predetermined flight direction, and control the angular velocity of the rotation shaft and the flap angle of the plurality of wings when the movement prediction information is different from a predetermined flight position.

The apparatus may further include a communication unit for receiving movement information of the boomerang through a network, wherein the control unit may control movement of the boomerang according to the received movement information.

The apparatus may further include an image processing unit for processing an image obtained through a camera mounted on the boomerang, wherein the control unit may control the boomerang to move in a departure direction when a destination image is extracted from the obtained image, and to stop when a departure image is extracted from the obtained image.

According to another aspect of the present invention, there is provided a method of controlling a boomerang by using an apparatus for controlling a boomerang, the method including: detecting moving information of a boomerang including a plurality of wings; generating movement prediction information of the boomerang by using the detected moving information; and controlling an angular velocity of a rotation shaft connected to the plurality of wings or a flap angle of the plurality of wings according to the generated movement prediction information.

According to another aspect of the present invention, there is provided a system for controlling a boomerang, the system including: an adjusting device for transmitting movement information predetermined in a boomerang including a plurality of wings, through a network; and an apparatus for controlling a boomerang, the apparatus including a communication unit for receiving the movement information, a detection unit for detecting moving information of the boomerang, a movement prediction unit for generating movement prediction information of the boomerang by using the detected moving information, and a control unit for controlling an angular velocity of a rotation shaft connected to the plurality of wings or a flap angle of the plurality of wings according to the generated movement prediction information.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, the present invention will be described more fully with reference to the accompanying drawings, in which exemplary embodiments of the invention are shown. Terms used herein shall not be limitedly construed as general or dictionary meanings, but shall be construed as meanings and concepts suitable to technical aspects of the present invention based on the principle that the inventor can suitably define the terms to describe the invention best way possible.

Figure 1:
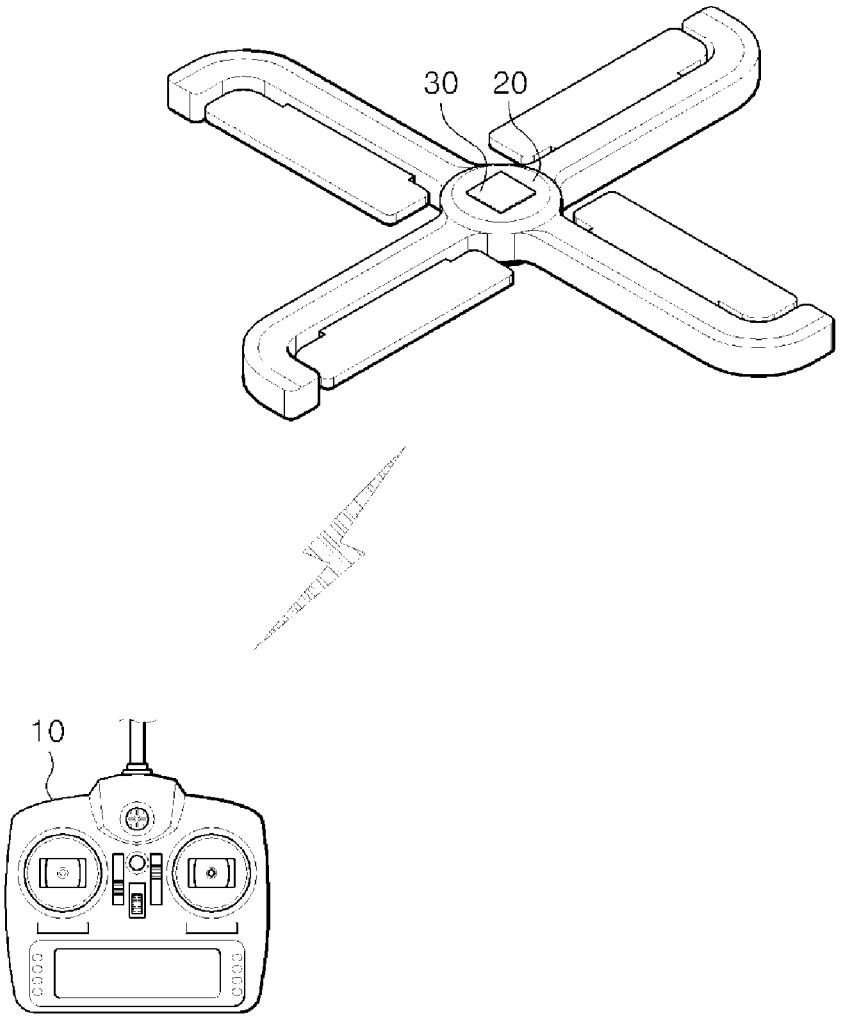
FIG. 1 is a diagram of a system for controlling a boomerang, according to an embodiment of the present invention.

FIG. 1 is a diagram of a system for controlling a boomerang, according to an embodiment of the present invention.

Referring to FIG. 1, the system according to the current embodiment includes an adjusting device 10 and an apparatus 30 for controlling a boomerang 20. Here, the boomerang 20 includes a flying object including a plurality of wings and flying the air as a lift force is generated in the wings according to a rotatory power when a user throws the flying object. The apparatus 30 is an apparatus that controls flight of the boomerang 20 by being mounted on the boomerang 20.

The adjusting device 10 transmits movement information predetermined in the boomerang 20 through a network. Here, the movement information includes moving information, such as a flight path, a flight position, and a flight speed of the boomerang 20, and for example, when the movement information is transmitted to the boomerang 20, the boomerang 20 may return back to an original location. Also, the movement information includes a control command that controls the boomerang 20 to return to a departure point after flying 30 meters, or return to a certain location coordinate, but the control command may differ according to the user. The adjusting device 10 may be a mobile terminal, such as a smart phone, a personal digital assistant (PDA), or a tablet personal computer (PC).

As described above, the apparatus 30 controls the flight of the boomerang 20 by being mounted on the boomerang 20. The apparatus 30 may receive the movement information through the adjusting device 10 to control the flight of the boomerang 20, or may store predetermined movement information to control the flight of the boomerang 20. Details about the apparatus 30 will be described in detail below with reference to FIGS. 2 through 5.

Figure 2:
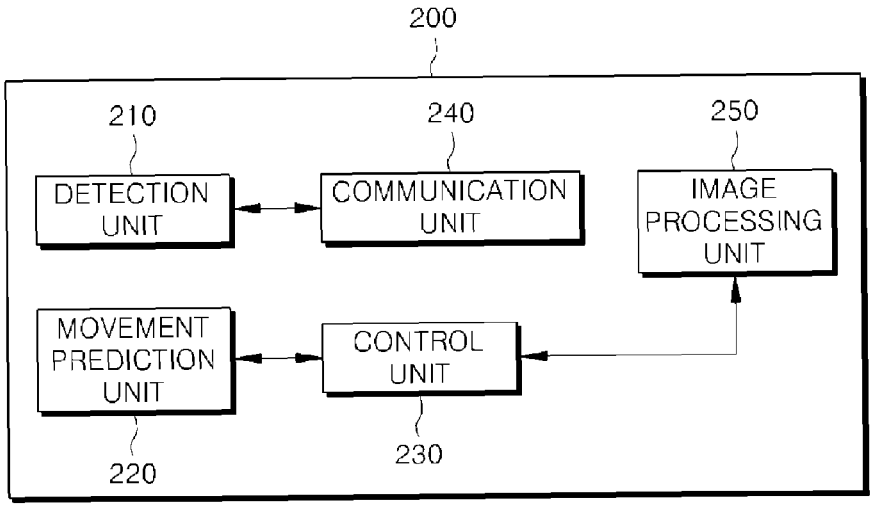
FIG. 2 is a block diagram of an apparatus for controlling a boomerang, which is included in the system of FIG. 1.
Figure 3:
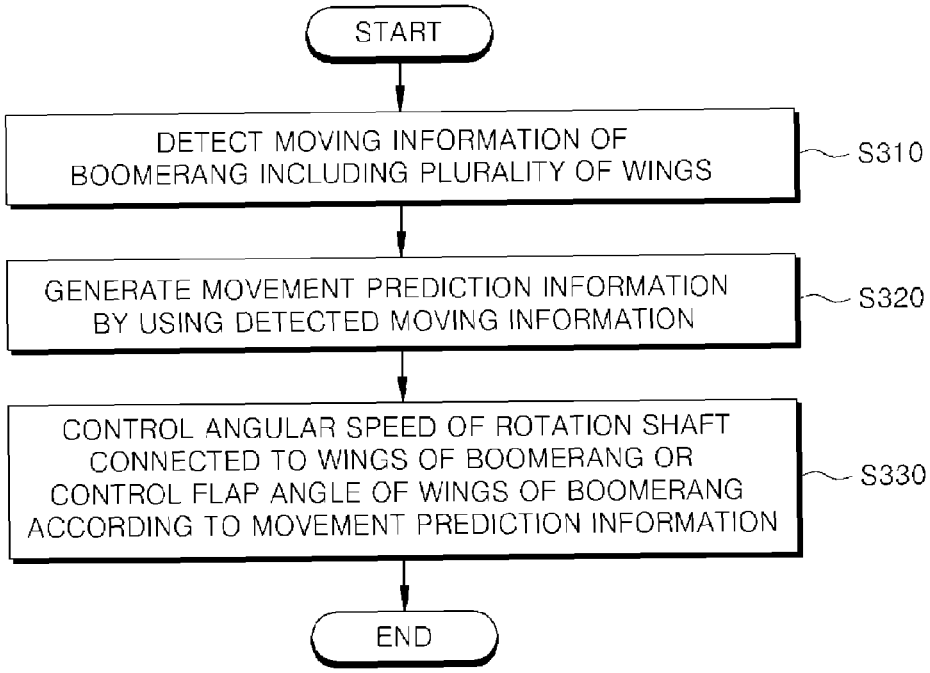
FIG. 3 is a flowchart illustrating a method of controlling a boomerang, by using the apparatus of FIG. 2.

FIG. 2 is a block diagram of an apparatus 200 for controlling a boomerang, which is included in the system of FIG. 1, and FIG. 3 is a flowchart illustrating a method of controlling a boomerang, by using the apparatus 200 of FIG. 2.

Referring to FIGS. 2 and 3, the apparatus 200 according to the current embodiment includes a detection unit 210, a movement prediction unit 220, a control unit 230, a communication unit 240, and an image processing unit 250.

The detection unit 210 detects moving information of a boomerang by detecting at least one of a tilt, a location, a flight speed, and an angular velocity of the boomerang, in operation S310. For example, the detection unit 210 includes at least one of an acceleration sensor, a gyro sensor, a tilt sensor, a speed sensor, and a global positioning system (GPS).

Then, the movement prediction unit 220 generates movement prediction information of the boomerang by using the moving information detected by the detection unit 210, in operation S320. For example, the movement prediction unit 220 may predict at least one of a flight speed, a flight direction, and a flight position of the boomerang by using tilt information, location information, and speed information of the boomerang. Also, the movement prediction unit 220 may predict a non-power flight time by predicting a lift force generated at wings of the boomerang by using angular velocity information of the boomerang. Also, flight of the boomerang may be controlled by recording a departure and a destination in location information.

Then, the control unit 230 controls the wings of the boomerang according to the movement prediction information generated by the movement prediction unit 220, in operation S330. In other words, the control unit 230 controls an angular velocity of a rotation shaft connected to the wings of the boomerang when the movement prediction information is different from a predetermined flight speed. Also, the control unit 230 may control a flap angle of the wings of the boomerang when the movement prediction information is different from a predetermined flight direction. Also, the control unit 230 may control the angular velocity of the rotation shaft and the flap angle of the wings when the movement prediction information is different from a predetermined flight position.

The boomerang may initially fly a certain distance without power according to a physical force applied by the user. However, after the certain distance, a lift force is decreased by resistance of wind, and thus the boomerang may no longer fly. At this time, the control unit 230 may control the flight speed, the flight direction, and the flight position by rotating the wings or changing the flap angle according to a power source of the boomerang. Accordingly, the boomerang may accurately move to a target point, and a flight distance may be extended if the boomerang is non-powered.

The apparatus 200 according to another embodiment of the present invention may further include the communication unit 240. The communication unit 240 receives movement information of the boomerang from an adjusting device through a network. Here, the movement information includes moving information of the boomerang. Also, the communication unit 240 may transmit information about the flight position, the flight speed, and the location of the boomerang detected by the detection unit 210 to the adjusting device, and may transmit the movement prediction information predicted by the movement prediction unit 220 to the adjusting device. Also, the communication unit 240 is capable of data communication with a base station or a terminal on a moving path of the boomerang.

The apparatus 200 according to another embodiment of the present invention may further include the image processing unit 250. The image processing unit 250 processes an image obtained through a camera mounted on the boomerang. In detail, the image obtained through the camera may have different photographing directions according to time as the boomerang rotates and moves. In this case, the image processing unit 250 may only store an image obtained when the boomerang is at a certain angle, from among a plurality of images obtained at predetermined time intervals. Alternatively, the image processing unit 250 may obtain an image through the camera only at a predetermined angle as the detection unit 210 detects a rotating angle of the boomerang.

Also, the image processing unit 250 may extract a predetermined departure image or destination image from among images obtained through the camera. In this case, the control unit 230 may control the boomerang to move in a departure direction when the destination image is extracted and to stop when the departure image is extracted.

For example, when the boomerang flies from a departure to a destination, the image processing unit 250 may determine an image having characteristics corresponding to the destination as the destination image from among the images obtained through the camera, and when the destination image is extracted, the control unit 230 may determine that the boomerang has arrived the destination and return the boomerang back to the departure. Also, when the boomerang flies from the destination to the departure, the image processing unit 250 may determine an image having characteristics corresponding to the departure as the departure image from among the images obtained through the camera, and when the departure image is extracted, the control unit 230 may determine that the boomerang has arrived the departure and stop the flight of the boomerang.

Figure 4A:
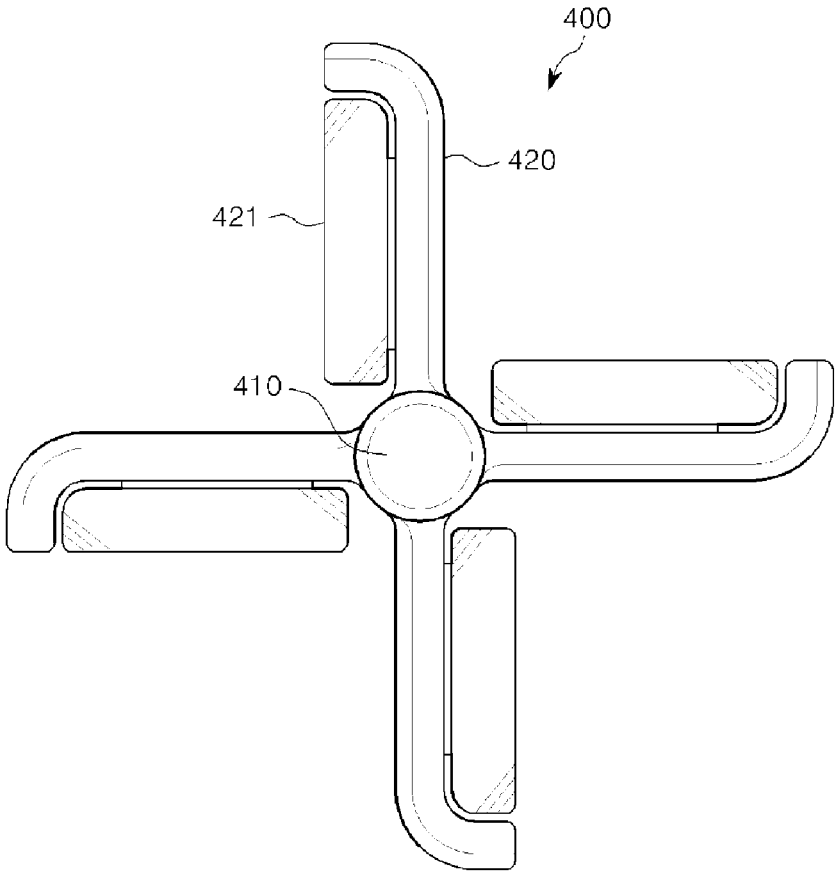
FIG. 4A is a plan view of a boomerang on which the apparatus of FIG. 2 is mounted.
Figure 4B:
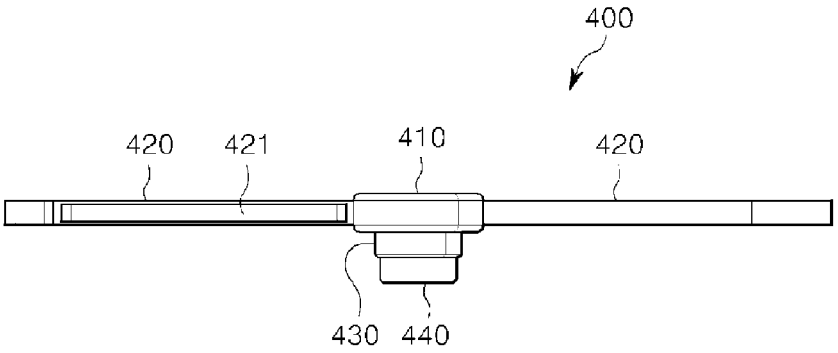
FIG. 4B is a cross-sectional view of the boomerang on which the apparatus of FIG. 2 is mounted.

FIG. 4A is a plan view of a boomerang 400 on which the apparatus 200 of FIG. 2 is mounted, and FIG. 4B is a cross-sectional view of the boomerang 400 on which the apparatus 200 of FIG. 2 is mounted.

First, referring to FIG. 4A, in the boomerang 400, a plurality of wings 420 are connected to a body 410, and an apparatus for controlling a boomerang, according to an embodiment of the present invention, is mounted on the body 410. Here, the number and shapes of the plurality of wings 420 connected to the body 410 may vary according to users. Also, the wing 420 may include a flap 421 so that a lift force of the wing 420 is adjustable. A solar cell may be attached to the wing 420.

Referring to FIG. 4B, a rotation shaft 430 is connected to the bottom of the body 410, and a camera 440 is disposed at the bottom of the rotation shaft 430. When the lift force is reduced while the boomerang 400 is flying without power, the rotation shaft 430 is rotated so that the body 410 and the wings 420 connected to the body 410 are rotated. Accordingly, the lift force is generated again at the wings 420 so that the boomerang 400 flies. At this time, the body 410 may further include a battery as well as the apparatus for controlling a boomerang, and the battery supplies power to the boomerang 400 while the boomerang is flying.

Figure 5:
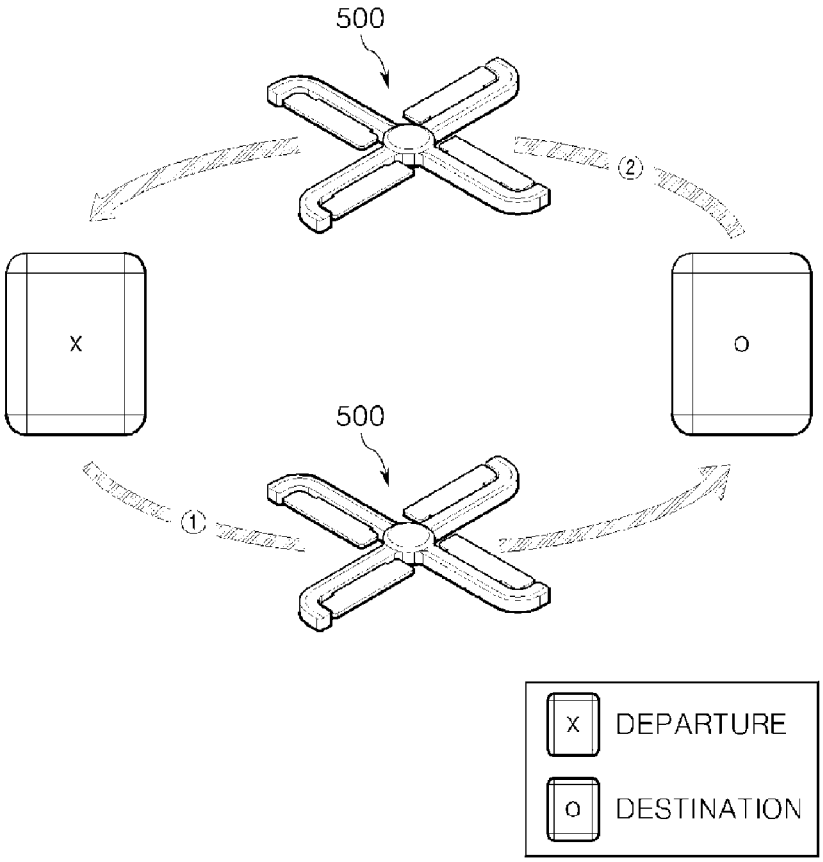
FIG. 5 is a diagram for exemplarily describing a flight path of a boomerang using the apparatus of FIG. 2.

FIG. 5 is a diagram for exemplarily describing a flight path of a boomerang 500 using the apparatus 200 of FIG. 2.

Referring to FIG. 5, the boomerang 500 may move in a first path ① moving from a departure that is a location where a user throws the boomerang 500 to a destination, and a second path ② returning from the destination to the departure. Here, the flight path may be set only in the first path ① by a user. Also, the boomerang 500 may photograph a sign X of the departure and a sign O of the destination through a camera, and when the sign O of the destination is extracted in the first path ①, the boomerang 500 may switch a direction to the second path ② and when the sign O of the departure is extracted in the second path ①, the flight of the boomerang 500 may be ended.

As described above, according to one or more embodiments of the present invention, flight of a boomerang may be controlled by using moving information of the boomerang so as to accurately move the boomerang to a target point. Also, a flight distance of the boomerang may be increased by switching a flight state from a non-power flight to a powered flight.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for controlling a boomerang, the apparatus comprising:

a detection unit for detecting moving information of a boomerang comprising a plurality of wings;

a movement prediction unit for generating movement prediction information of the boomerang by using the detected moving information; and a control unit for controlling an angular velocity of a rotation shaft connected to the plurality of wings or a flap angle of the plurality of wings of the boomerang according to the generated movement prediction information, wherein the control unit controls the angular velocity of the rotation shaft when the movement prediction information is different from a predetermined flight speed, controls the flap angle of the plurality of wings when the movement prediction information is different from a predetermined flight direction, and controls the angular velocity of the rotation shaft and the flap angle of the plurality of wings when the movement prediction information is different from a predetermined flight position.

2. The apparatus of claim 1, wherein the detection unit detects at least one of a tilt, a location, a flight speed, and an angular velocity of the boomerang.

3. The apparatus of claim 1, further comprising a communication unit for receiving movement information of the boomerang through a network, wherein the control unit controls movement of the boomerang according to the received movement information.

4. The apparatus of claim 1, further comprising an image processing unit for processing an image obtained through a camera mounted on the boomerang, wherein the control unit controls the boomerang to move in a departure direction when a destination image is extracted from the obtained image, and to stop when a departure image is extracted from the obtained image.

5. A method of controlling a boomerang by using an apparatus for controlling a boomerang, the method comprising:

detecting moving information of a boomerang comprising a plurality of wings;

generating movement prediction information of the boomerang by using the detected moving information; and controlling an angular velocity of a rotation shaft connected to the plurality of wings or a flap angle of the plurality of wings according to the generated movement prediction information, wherein the controlling comprises controlling the angular velocity of the rotation shaft when the movement prediction information is different from a predetermined flight speed, controlling the flap angle of the plurality of wings when the movement prediction information is different from a predetermined flight direction, and controls the angular velocity of the rotation shaft and the flap angle of the plurality of wings when the movement prediction information is different from a predetermined flight position.

6. The method of claim 5, wherein the detecting of the moving information comprises detecting at least one of a tilt, a location, a flight speed, and an angular velocity of the boomerang.

7. The method of claim 5, further comprising receiving movement information of the boomerang through a network, wherein the controlling comprises controlling movement of the boomerang according to the received movement information.

8. The method of claim 5, further comprising processing an image obtained through a camera mounted on the boomerang, wherein the controlling comprises controlling the boomerang to move in a departure direction when a destination image is extracted from the obtained image, and to stop when a departure image is extracted from the obtained image.

9. A system for controlling a boomerang, the system comprising:

an adjusting device for transmitting movement information predetermined in a boomerang comprising a plurality of wings, through a network; and an apparatus for controlling a boomerang, the apparatus comprising a communication unit for receiving the movement information, a detection unit for detecting moving information of the boomerang, a movement prediction unit for generating movement prediction information of the boomerang by using the detected moving information, and a control unit for controlling an angular velocity of a rotation shaft connected to the plurality of wings or a flap angle of the plurality of wings according to the generated movement prediction information, wherein the control unit controls the angular velocity of the rotation shaft when the movement prediction information is different from a predetermined flight speed, controls the flap angle of the plurality of wings when the movement prediction information is different from a predetermined flight direction, and controls the angular velocity of the rotation shaft and the flap angle of the plurality of wings when the movement prediction information is different from a predetermined flight position.

* * * * *